US007387354B2

(12) United States Patent
Usuda

(10) Patent No.: US 7,387,354 B2
(45) Date of Patent: Jun. 17, 2008

(54) WAVEFORM DETERMINING DEVICE, WAVEFORM DETERMINING METHOD, DROPLET EJECTING DEVICE, DROPLET EJECTING METHOD, FILM FORMING METHOD, DEVICE MANUFACTURING METHOD, ELECTRONIC OPTICAL DEVICE, AND ELECTRONIC DEVICE

(75) Inventor: Hidenori Usuda, Matsumoto (JP)

(73) Assignee: Seiko Epson Corporation (JP)

( * ) Notice: Subject to any disclaimer, the term of this patent is extended or adjusted under 35 U.S.C. 154(b) by 136 days.

(21) Appl. No.: 10/752,311

(22) Filed: Jan. 6, 2004

(65) Prior Publication Data

US 2004/0189732 A1 Sep. 30, 2004

(30) Foreign Application Priority Data

Jan. 9, 2003 (JP) ..... 2003-003726

(51) Int. Cl.
*B41J 29/38* (2006.01)

(52) U.S. Cl. ..... 347/10; 347/19; 347/11

(58) Field of Classification Search ..... 347/19, 347/10, 11

See application file for complete search history.

(56) References Cited

U.S. PATENT DOCUMENTS 4,238,807 A * 12/1980 Bovio et al. ..... 347/55
5,889,351 A * 3/1999 Okumura et al. ..... 310/321
6,102,507 A * 8/2000 Yoshida ..... 347/6
6,331,040 B1 * 12/2001 Yonekubo et al. ..... 347/15
6,685,300 B1 2/2004 Ishiyama et al.
6,984,010 B2 * 1/2006 Hosono et al. ..... 347/19
2005/0104921 A1 * 5/2005 Watanabe et al. ..... 347/19

FOREIGN PATENT DOCUMENTS

CN 1280915 A 1/2001
JP 6-182997 7/1994
JP 10-202884 8/1998

OTHER PUBLICATIONS

Communication from Chinese Patent Office regarding related application.

* cited by examiner

*Primary Examiner*—Manish S. Shah
*Assistant Examiner*—Laura E Martin
(74) *Attorney, Agent, or Firm*—Harness, Dickey & Pierce, P.L.C.

(57) ABSTRACT

A measurement unit obtains, when a droplet ejected from an ejecting head adheres to an electrode of a crystal oscillator, a viscosity and a mass of the droplet on the basis of a changed value in resonance frequency and of a resonance resistance of crystal oscillator. Measurement unit then supplies to a control unit droplet information ID showing the obtained viscosity and mass. Control unit determines, on the basis of the viscosity and the mass included in droplet information ID, an appropriate drive waveform to be supplied to ejecting head.

16 Claims, 9 Drawing Sheets

*FIG. 4*

TBL

| | | VISCOSITY $\eta$ (mPa · s) | | | | | | |
|---|---|---|---|---|---|---|---|---|
| | | 6.0 | 6.5 | 7.0 | 7.5 | 8.0 | 8.5 | |
| MASS Im (ng) | 9.5 | 26.0 | 26.5 | 27.0 | 27.5 | 28.0 | 28.5 | VOLTAGE DROP AMOUNT $\Delta$V (v) |
| | 9.6 | 25.8 | 26.2 | 26.6 | 27.0 | 27.4 | 27.8 | |
| | 9.7 | 25.6 | 25.9 | 26.2 | 26.5 | 26.8 | 27.1 | |
| | 9.8 | 25.4 | 25.6 | 25.8 | 26.0 | 26.2 | 26.4 | |
| | 9.9 | 25.2 | 25.3 | 25.4 | 25.5 | 25.6 | 25.7 | |
| | 10.0 | 25.0 | 25.0 | 25.0 | 25.0 | 25.0 | 25.0 | |
| | 10.1 | 24.8 | 24.7 | 24.6 | 24.5 | 24.4 | 24.3 | |
| | 10.2 | 24.6 | 24.4 | 24.2 | 24.0 | 23.8 | 23.6 | |
| | 10.3 | 24.4 | 24.1 | 23.8 | 23.5 | 23.2 | 22.9 | |
| | | A | B | C | D | E | F | WAVEFORM TYPE |

WAVEFORM DETERMINING DEVICE, WAVEFORM DETERMINING METHOD, DROPLET EJECTING DEVICE, DROPLET EJECTING METHOD, FILM FORMING METHOD, DEVICE MANUFACTURING METHOD, ELECTRONIC OPTICAL DEVICE, AND ELECTRONIC DEVICE

TECHNICAL FIELD

The present invention relates to a method for determining a drive waveform, the method for use in a droplet ejecting device having an ejecting head for ejecting a droplet in accordance with the supplied drive waveform, and to a waveform determining device; and also relates to an associated droplet ejecting method, to a droplet ejecting device, to a film forming method, to a device manufacturing method, to an electronic optical device, and to an electronic device.

BACKGROUND ART

A droplet ejecting device, such as an inkjet device, is commonly provided with an ejecting head where a liquid is temporarily stored, and also with a piezoelectric element for pressurizing the liquid stored in the ejecting head. To eject a liquid from the ejecting head, a drive signal is supplied to a piezoelectric element on the basis of a drive waveform. The drive waveform refers to data prescribing a time-sequential signal level of a drive signal applied for enabling ejection of a single droplet. Accordingly, it is possible to achieve high-precision patterning by consistently ejecting a droplet that is close to a desired value.

However, if a change in temperature occurs, a change in a viscosity of a liquid to be ejected may also occur. Thus, if a drive waveform for controlling ejection of a liquid droplet remains unchanged regardless of a change in temperature, variations in a volume of a liquid droplet ejected will also occur. Namely, a decrease in temperature of a liquid may result in an increase in a viscosity of the liquid, with the result that a droplet of the liquid ejected will have decreased volume.

To solve this problem, a technique is known for detecting a liquid temperature within an ejecting head by means of a thermal sensor provided close to the ejecting head, estimating a viscosity of the liquid from the detected temperature, and determining a drive waveform on the basis of the estimated viscosity such that a volume of a droplet ejected does not essentially change. Consequently, as compared to a fixed drive waveform method, this method provides a more stable droplet output since it employs a drive waveform that is changeable on the basis of an estimated viscosity of a liquid for droplet ejection.

However, a problem exists with such a method in that a viscosity used for the determination of a drive waveform is a value that is indirectly obtained on the basis of a temperature of a liquid for droplet ejection, and therefore an actual viscosity of the liquid may not be accurately determined. Moreover, a temperature of a liquid residing in an ejecting head is not generally uniform, and detection of the liquid's temperature will also vary depending on where a thermal sensor is provided. Consequently, in the prior art method and device a volume of an ejected droplet is subject to variance, and cannot be sufficiently accurately controlled.

SUMMARY

The present invention has been made in view of the problems stated above, and has as its object the provision of a waveform determining device for determining a drive waveform for use in ejecting droplets of liquid of a constant mass; and is also directed to, a waveform determining method executed by the waveform determining device; a droplet ejecting device comprising the waveform determining device; a droplet ejecting method including the waveform determining method; a film forming method using the droplet ejecting method; a device manufacturing method using the film forming method; to a method of manufacturing an electronic optical device using the device manufacturing method; an electronic optical device manufactured by the manufacturing method for manufacturing an electronic optical device; and an electronic device provided with the electronic optical device.

To achieve the stated object, the present invention provides a waveform determining device comprising measuring means for measuring a viscosity and a mass of a droplet ejected from an ejecting head for ejecting a droplet in accordance with a drive waveform; and waveform determining means for determining a drive waveform to be supplied to the ejecting head on the basis of the viscosity and mass of the droplet measured by the measuring means.

According to the waveform determining device of the present invention, a drive waveform is determined on the basis of a viscosity and a mass of a droplet ejected from the ejecting head, such that the determined waveform causes a droplet of a constant mass to be ejected.

In a preferred embodiment, the measuring means comprises: a piezoelectric element having an electrode to which a voltage is applied to cause the piezoelectric element to vibrate, such that when the droplet ejected from the ejecting head adheres to the electrode during application of a voltage, the piezoelectric element vibrates at a resonance frequency that is dependent on a viscosity and a mass of the adhering droplet, and the piezoelectric element also indicates a resonance resistance that is dependent on a viscosity of the adhering droplet; resonance resistance value obtaining means for obtaining a resonance resistance value of the piezoelectric element when the droplet ejected from the ejecting head adheres to the electrode; frequency change obtaining means for obtaining a difference in resonance frequency of the piezoelectric element at a time of adhesion of the droplet to the electrode and at a time of no adhesion of the droplet to the electrode; and computing means for computing the viscosity and the mass of the droplet adhering to the electrode on the basis of the resonance resistance value obtained by the resonance resistance value obtaining means and the difference in resonance frequency of the piezoelectric element obtained by the frequency change obtaining means.

Thus, a viscosity and a mass of a droplet are computed on the basis of a resonance resistance of a piezoelectric element and a difference in resonance frequency of the piezoelectric element droplet, whereby a viscosity and a mass of each droplet can be measured. As a result, droplets ejected for the purpose of determining an appropriate drive waveform can be minimized, which means that a large number of test droplets do not have to be ejected, thus enabling resource-saving in a process of determining a drive waveform.

In another preferred embodiment, the droplet measured by the measuring means is ejected when a predetermined standard drive waveform is supplied to the ejecting head, and wherein the waveform determining means comprises:

waveform storing means for storing a plurality of drive waveforms, each drive waveform corresponding to a viscosity and a mass of the droplet ejected from the ejecting head in accordance with the standard drive waveform and causing ejection of a droplet of an approximately constant volume from the ejecting head; and waveform selecting means for selecting, from among the plurality of drive waveforms stored in the waveform storing means, a drive waveform corresponding to the viscosity and the mass of the droplet measured by the measuring means to supply the selected drive waveform to the ejecting head.

Thus, a drive waveform is selected from among drive waveforms stored in the waveform storing means, thereby determining a drive waveform to be supplied to the ejecting head. A process of determining a drive waveform is thus able to be simplified.

Further, the present invention provides a droplet ejecting device comprising an ejecting head for ejecting a droplet in accordance with a drive waveform, and a waveform determining device in one of various embodiments described above, the droplet ejecting device supplying to the ejecting head the drive waveform determined by the waveform determining device.

As described above, the waveform determining device according to the present invention enables droplets of a constant mass to be ejected from an ejecting head, which in turn enables highly precise application of droplets in the droplet ejecting device.

Further, the present invention provides a waveform determining method comprising: a measuring step of measuring a viscosity and a mass of a droplet ejected from an ejecting head for ejecting a droplet in accordance with a drive waveform; and a waveform determining step of determining a drive waveform to be supplied to the ejecting head on the basis of the viscosity and the mass of the droplet measured in the measuring step.

According to the waveform determining method, as in the case of the waveform determining device, a drive waveform can be determined on the basis of a viscosity and a mass of a droplet ejected from the ejecting head such that the determined waveform causes a droplet of a constant mass to be ejected.

In one preferred embodiment, the measuring step comprises: a droplet ejection step of ejecting a droplet from the ejecting head toward an electrode of a piezoelectric element, the piezoelectric element being caused to vibrate when a voltage is applied to the electrode, such that when a droplet ejected from the ejecting head adheres to the electrode during application of a voltage, the piezoelectric element vibrates at a resonance frequency that is dependent on a viscosity and a mass of the adhering droplet, and the piezoelectric element also indicates a resonance resistance that is dependent on a viscosity of the adhering droplet; a resonance resistance value obtaining step of obtaining a resonance resistance value of the piezoelectric element when the droplet ejected from the ejecting head adheres to the electrode in the droplet ejection step; a frequency change obtaining step of obtaining a difference in resonance frequency of the piezoelectric element at a time of adhesion of the droplet to the electrode and at a time of no adhesion of the droplet to the electrode; and a computing step of computing the viscosity and the mass of the droplet adhering to the electrode on the basis of the resonance resistance value obtained in the resonance resistance value obtaining step and the difference in resonance frequency of the piezoelectric element obtained in the frequency change obtaining step.

Thus, a viscosity and a mass of a droplet are computed on the basis of a resonance resistance of a piezoelectric element and a changed value in resonance frequencies, whereby a viscosity and a mass of a droplet can be computed for each droplet. Therefore, in determining a drive waveform it is not necessary to use a large number of droplets, and resource-saving in a process of determining a drive waveform is enabled.

In another preferred embodiment, the droplet measured in the measuring step is ejected when a predetermined standard drive waveform is supplied to the ejecting head; further, in the waveform determining step, a drive waveform that corresponds to the viscosity and the mass of the droplet measured in the measuring step is selected as the drive waveform to be supplied to the ejecting head, from among a plurality of drive waveforms stored in a waveform storing means, with each drive waveform corresponding to a viscosity and a mass of a droplet ejected from the ejecting head in accordance with the standard drive waveform and causing ejection of a droplet of an approximately constant volume from the ejecting head.

Thus, a drive waveform is selected from among a plurality of drive waveforms stored in a storage device, thereby enabling a simplified process of determining a drive waveform.

In still another preferred embodiment, the above waveform determining method may further comprise an initial droplet ejection step, which takes place before the droplet ejection step, and consists of ejecting from the ejecting head a droplet approximately towards an edge of the electrode, wherein the droplet ejection step includes ejecting a droplet from the ejecting head approximately towards a center of the electrode.

Thus, an initial droplet ejection step of causing a droplet to adhere to an edge of the electrode is provided; and a change in a resonance resistance is caused at the piezoelectric element in stages in the initial droplet ejection step and the droplet ejection step. As a result, a viscosity and a mass of a droplet can be highly precisely measured.

The present invention further provides a droplet ejecting method for supplying to an ejecting head a drive waveform determined by the waveform determining method as described above in various embodiments, thereby causing ejection of a droplet from the ejecting head.

Additionally, the present invention provides a film forming method comprising a manufacturing process of applying a droplet using the droplet ejecting method; a device manufacturing method comprising a manufacturing process of forming a film using the film forming method; a manufacturing method of manufacturing an electronic optical device comprising a manufacturing process of the device manufacturing method; an electronic optical device manufactured using the manufacturing method; and an electronic device in which the electronic optical device is provided as a display unit.

BRIEF DESCRIPTION OF THE DRAWING

FIG. 4 is a diagram illustrating an example of a waveform selection table stored in a storage unit.

DETAILED DESCRIPTION OF PREFERRED EMBODIMENTS

Hereinafter, description will be given, with reference to the drawings, of a droplet ejecting device provided with a waveform determining device according to one embodiment of the present invention. In the following description, a droplet ejecting device for use in manufacturing a color filter included in an electronic optical device will be explained as an example of such a droplet ejecting device.

Figure 1:
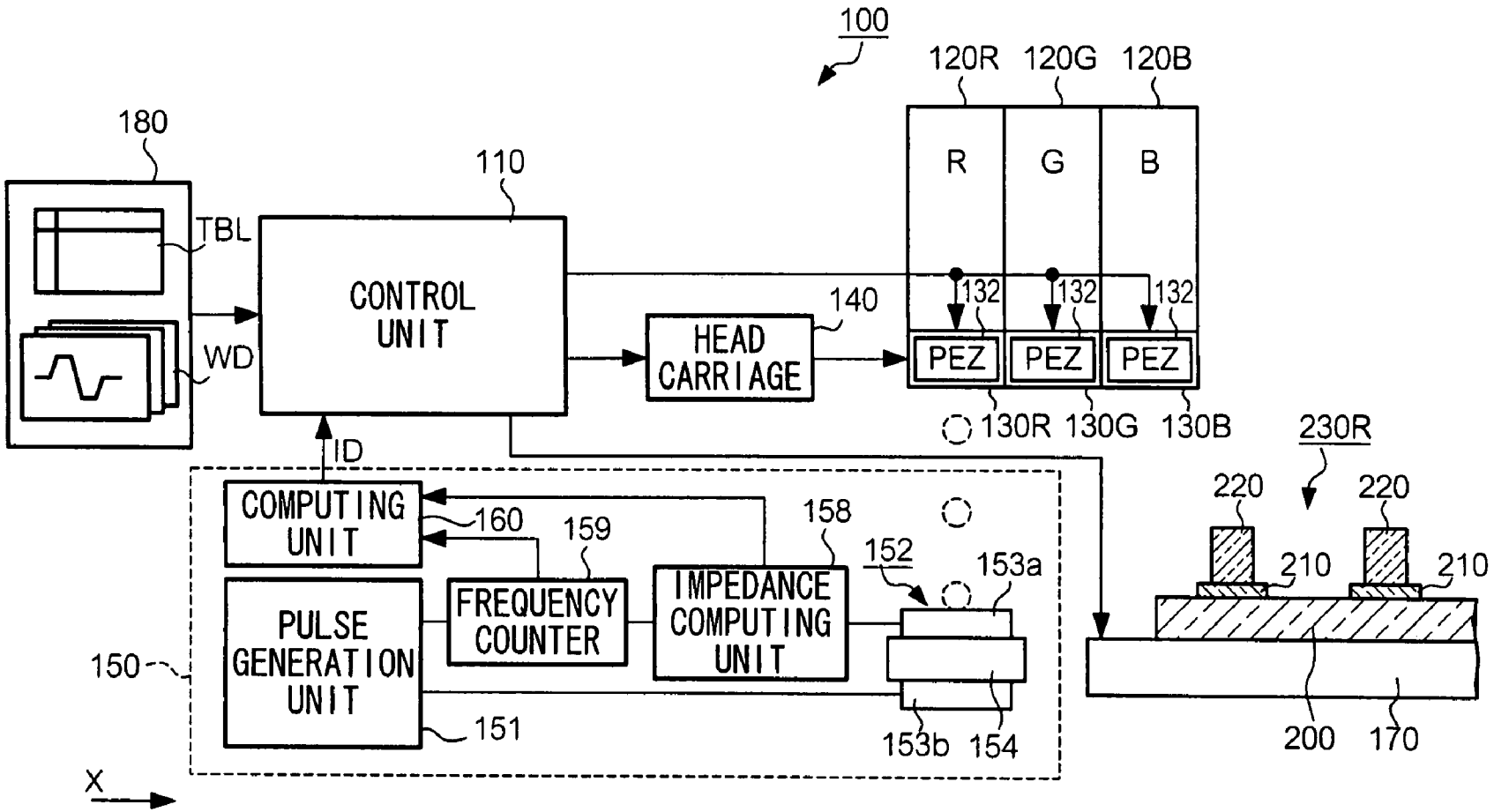
FIG. 1 is a diagram showing an example of a configuration of a droplet ejecting device according to an embodiment of the present invention.

FIG. 1 is a diagram showing an example of a configuration of a droplet ejecting device 100 according to one embodiment of the present invention. In the figure, control unit 110 comprises a CPU (Central Processing Unit) or the like, and controls the entire droplet ejecting device 100. Control unit 110 controls, for example, a scanning process of a substrate 200 for a color filter. Further, control unit 110 controls a process of determining a drive waveform on the basis of information supplied from a measurement unit 150 (described later in detail) and supplying a drive signal to ejecting heads 130R, 130G, and 130B according to the determined drive waveform.

Tanks 120R, 120G, 120B each store ink for a color filter, such as acrylic resin or polyurethane resin colored by inorganic pigment. Specifically, red ink is stored in tank 120R; green ink is stored in tank 120G; and blue ink is stored in tank 120B. Each color ink is dried after being applied to substrate 200, and thereafter, selectively transmits light of a wavelength corresponding to its color, either red, green or blue.

In the present embodiment, it is assumed for convenience that red ink, green ink, and blue ink have nearly identical liquid characteristics such as a change in viscosity dependent on a change in temperature, and exhibit the same fluid behavior under the same conditions. Therefore, where conditions pertaining to droplet ejection are identical, the same volume of droplet is ejected regardless of a color of the ink used in forming a droplet.

An ejecting head 130R comprises a pressure chamber, a piezoelectric element 132, and a nozzle. The pressure chamber is in connective communication with an inside of tank 120R, and temporarily stores red ink supplied from tank 120R. Piezoelectric element 132 deforms an inside surface of the pressure chamber according to a drive signal supplied from control unit 110, and consequently pressurizes or depressurizes red ink in the pressure chamber. A droplet of red ink is ejected from a nozzle of ejecting head 130R in response to an increase and decrease in pressure exerted on the red ink by piezoelectric element 132.

Figure 2:
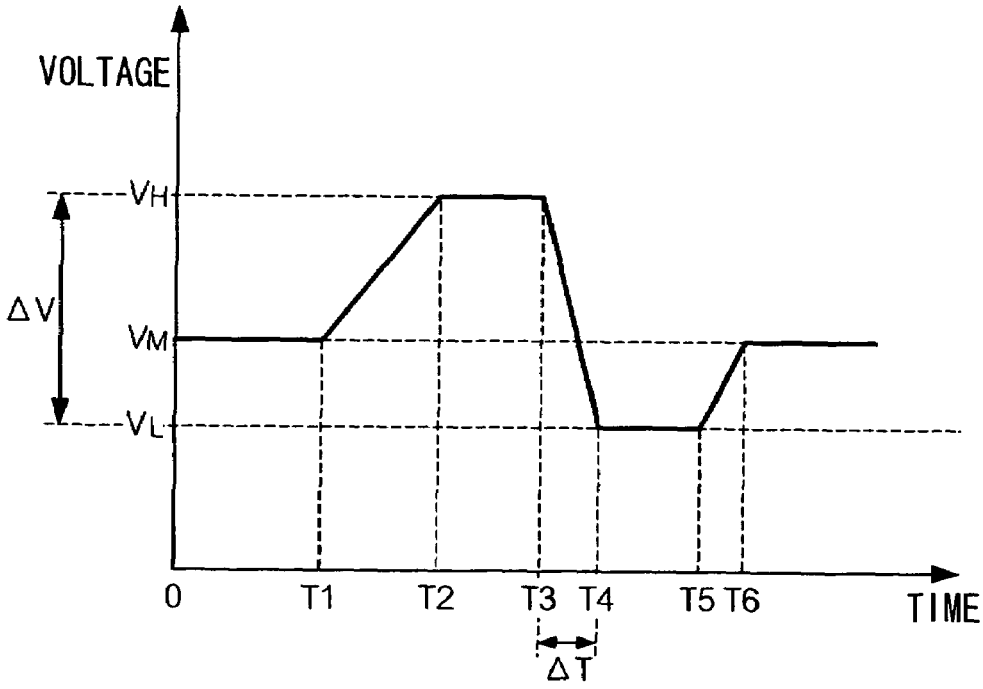
FIG. 2 is a diagram showing an example of a drive waveform.

FIG. 2 is a diagram showing an example of a drive waveform data for prescribing a time-sequential drive signal for supply to piezoelectric element 132 to enable ejection of a single droplet.

As shown in the figure, a drive signal to be supplied to piezoelectric element 132 is a constant value $V_M$ during a period from time 0 to time T1. During this period, piezoelectric element 132 is not deformed. In a subsequent period from time T1 to time T2, the drive signal rises from $V_M$ to $V_H$. When such a drive signal is applied, piezoelectric element 132 is deformed so as to depressurize red ink in the pressure chamber, thereby causing red ink to flow from tank 120R into the pressure chamber.

Next, a drive signal is again supplied at a constant value $V_H$ during a period from time T2 to time T3, and during a subsequent period from time T3 to time T4, the drive signal drops from $V_H$ to $V_L$. This drop in the drive signal causes piezoelectric element 132 to be deformed to pressurize red ink in the pressure chamber. As a result, red ink in the pressure chamber is ejected from the nozzle in the form of a liquid column protruding from the nozzle. In the following description, the period from time T3 to time T4 will be referred to as a voltage drop period ΔT, and an amount of voltage $V_H$-$V_L$ that drops during the voltage drop period ΔT is referred to as a voltage drop amount ΔV.

Subsequently, during a period from time T4 to time T5, the drive signal at a constant value $V_L$ is supplied. During a subsequent time T5 to time T6, the drive signal rises from $V_L$ to $V_M$. The rise in the drive signal causes piezoelectric element 132 to deform so as to depressurize red ink in the pressure chamber, the ink liquid column once ejected during the above voltage drop period ΔT is retracted and a part of the liquid column is ejected as a droplet.

Description will be now given of a technique for changing a droplet amount by adjusting the voltage drop period ΔT or the voltage drop amount ΔV of the drive waveform. When the voltage drop period ΔT is shortened, a time period for the liquid being subject to increased pressure is also shortened. As a result, ink ejected from the nozzle during the voltage drop period ΔT is accelerated, and a droplet amount is increased. Conversely, when the voltage drop period ΔT is lengthened, ink ejected from the nozzle is decelerated, and a droplet amount is decreased.

When the voltage drop amount ΔV is enlarged, the ink is subject to a more increased pressure, whereby an amount of ink ejected from the nozzle during the voltage drop period ΔT is increased. As a result, a droplet amount is also increased. Conversely, when the voltage drop amount ΔV is decreased, an amount of ink ejected from the nozzle decreases, thereby decreasing a droplet amount. This technique is widely used in ejecting a droplet of different amounts selectively from one nozzle since it enables a change in a droplet amount without requiring any mechanical change to be made to ejecting heads 130R, 130G, and 130B such as a nozzle diameter.

In FIG. 1, ejecting head 130G has the same configuration as ejecting head 130R and ejects a green ink droplet responsive to a drive signal supplied from control unit 110, the green ink being supplied from tank 120G. Likewise, ejecting head 130B ejects a blue ink droplet responsive to a drive signal supplied from control unit 110, the blue ink being supplied from tank 120B. In the following, an ejecting head 130 is used where the distinction between ejecting head 130R, ejecting head 130G, and ejecting head 130B is unnecessary.

A head carriage 140 carries, under control of control unit 110, ejecting head 130 in parallel to a subscanning direction (X-direction in the figure) of droplet ejecting device 100.

Measurement unit 150 obtains a viscosity and a mass of a droplet ejected from each ejecting head 130. The unit 150 comprises a pulse generation unit 151, a sensor tip 152, an impedance computing unit 158, a frequency counter 159, and a computing unit 160. Pulse generation unit 151 supplies a pulse signal to sensor tip 152, thereby vibrating a piezoelectric element included in sensor tip 152.

Figure 3:
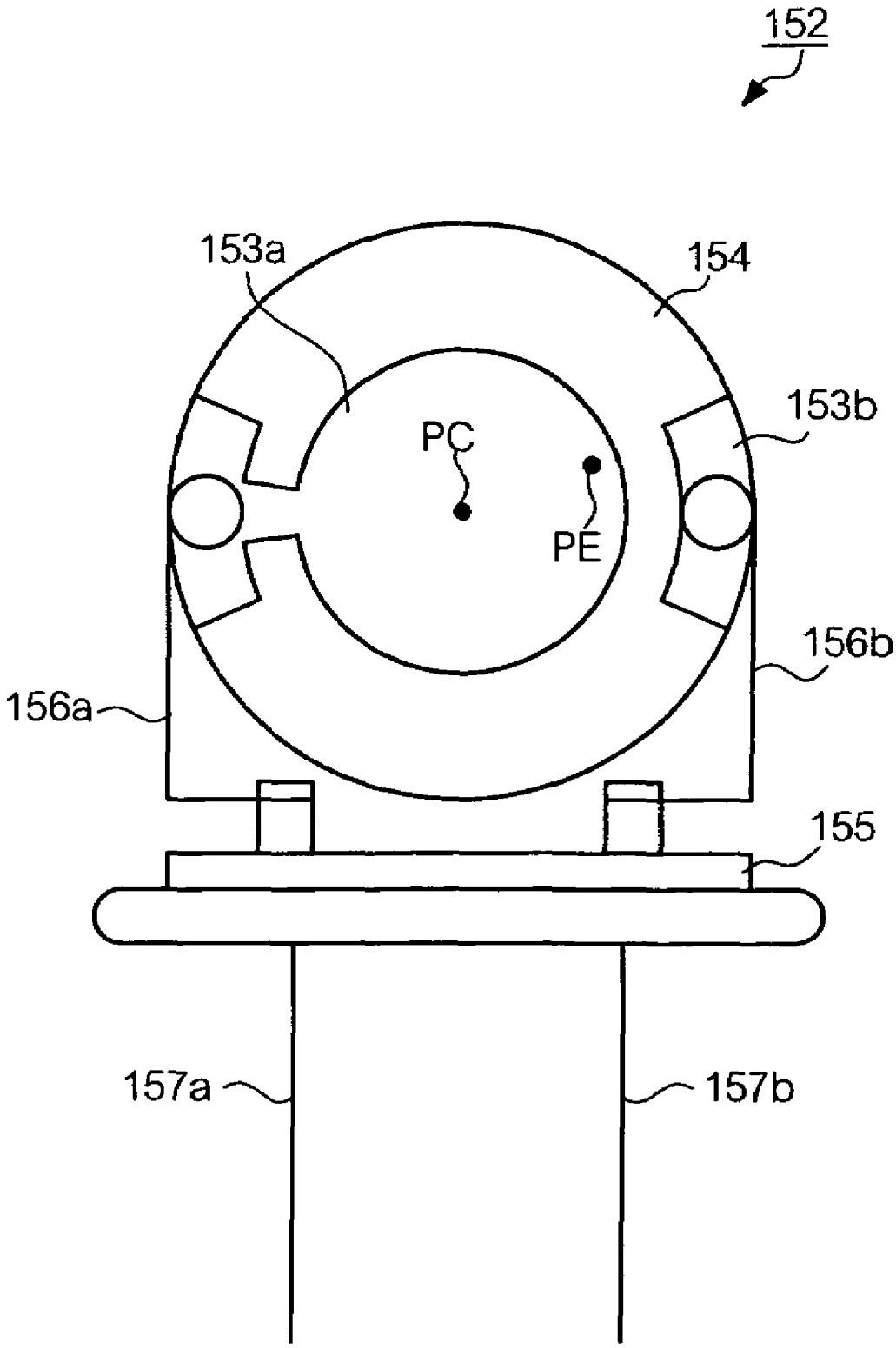
FIG. 3 is a diagram showing an example of a sensor tip in the droplet ejecting device.

FIG. 3 is a diagram showing an example of a configuration of sensor tip 152. In the figure, crystal oscillator 154 is a piezoelectric element such as an AT cut crystal oscillator. A pair of electrodes 153*a* and 153*b* is mounted on both surfaces, approximately facing each other. Insulator 155 supports crystal oscillator 154 by means of conductive support member 156*a* and 156*b* such that crystal oscillator 154 is able to vibrate. Support member 156*a* is in an electrical connection with electrode 153*a*, and also with a terminal 157*a* mounted to insulator 155. Similarly, support member 156*b* is in an electrical connection with electrode 153*b* and also with a terminal 157*b* mounted to insulator 155. With this configuration, a pulse signal output from pulse generation unit 151 is input via terminal 157*a* and 157*b* to sensor tip 152, whereby crystal oscillator 154 vibrates at a resonance frequency.

As shown in FIG. 1, sensor tip 152 is mounted so that electrode 153*a* opposes a droplet ejection surface of ejecting head 130. When a droplet ejected from ejecting head 130 drops to adhere to electrode 153*a*, measurement unit 150 obtains a viscosity and a mass of a droplet adhering to electrode 153*a*. Head carriage 140 is capable of carrying each ejecting head 130 to a position where a droplet ejected from each ejecting head 130 drops on the surface region of electrode 153*a* to adhere to electrode 153*a*.

Crystal oscillator 154 vibrates at a certain resonance frequency when an external force acting thereon is unchanged; but when a droplet is adhered to electrode 153*a* and the external force changes consequently, a resonance frequency at crystal oscillator 154 changes in response to a change of the external force. In other words, crystal oscillator 154 has a characteristic of vibrating, when a droplet adheres to electrode 153*a*, at a resonance frequency depending on a mass and a viscosity of a droplet. Measurement unit 150 uses this characteristic of crystal oscillator 154 to obtain a mass and viscosity of a droplet.

Impedance computing unit 158 obtains a resonance resistance value of crystal oscillator 154 by computation, and supplies a signal showing the resonance resistance value to computing unit 160. Frequency counter 159 detects a resonance frequency of crystal oscillator 154, and supplies a signal showing a result of the detection to computing unit 160.

Computing unit 160 receives the signal showing the resonance resistance value output from impedance computing unit 158, and the signal showing the resonance frequency output from frequency counter 159, and then obtains on the basis of the two signals, a viscosity and a mass of a droplet as in the following.

The relationship between resonance resistance value R and a viscosity η of a droplet adhering to electrode 153*a* can be expressed as:

$$R = \frac{A}{K^2}(2 \times \pi \times F \times \rho_L \times \eta)^{\frac{1}{2}} \tag{1}$$

where, K is an electromechanical coupling constant showing a degree of an electromechanical coupling of a piezoelectric material and a magnetostrictive material; A is a surface area of crystal oscillator 154; F is a basic frequency of crystal oscillator 154; and $\rho_L$ is a density of a droplet (ink).

Where a changed value in resonance frequency of crystal oscillator 154 between before and after a droplet adheres to electrode 153*a* is Δfreq, the relationship between the changed value Δfreq and viscosity η can be expressed as:

$$\Delta freq = -F^{\frac{3}{2}} \times \left(\frac{\rho_L \times \eta}{\pi \times \rho_Q \times \mu}\right)^{\frac{1}{2}} \tag{2}$$

where, $\Delta_Q$ is a density of crystal oscillator 154, and μ is an elastic modulus of crystal oscillator 154.

Where a mass of a droplet adhering to electrode 153*a* is Im, the relationship between a mass Im and a changed value Δfreq of a resonance frequency is expressed as:

$$\mathrm{Im} = \frac{-\Delta freq \times A \times \sqrt{\mu_Q \times \rho_Q}}{2 \times F \times F} \tag{3}$$

where, $\mu_Q$ is an AT cut crystal oscillator constant.

Thus, a resonance resistance value changes depending on a viscosity η of a droplet (see Equation (1)). A changed value Δfreq of a resonance frequency changes depending on a viscosity η of a droplet and a mass Im (see Equation (2) and (3)). Therefore, computing unit 160 uses a resonance frequency supplied from frequency counter 159 to compute a changed value Δfreq of resonance frequencies of crystal oscillator 154 between before and after a droplet adheres to electrode 153*a*. Computing unit 160 then substitutes a resonance resistance value supplied from impedance computing unit 158 and the computed changed value Δfreq into Equation (1) and (2) to obtain a viscosity η of a droplet as well as the density $\rho_L$ of the ink. Computing unit 160 also substitutes the changed value Δfreq into Equation (3), thereby obtaining a mass Im of a droplet.

Computing unit 160 thus obtains a viscosity η and a mass Im of a droplet, and supplies, to control unit 110, droplet information ID indicating them.

Substrate carriage 170 supports a substrate 200 for a color filter, and carries substrate 200, under control of control unit 110, in a subscanning direction in relation to ejecting head 130 (a direction perpendicular to a paper surface).

Storage unit 180 stores a waveform selection table TBL and waveform data WD. The waveform selection table TBL is a table for storing information for defining a drive waveform for ejecting a droplet of a desired mass from ejecting head 130 depending on a viscosity η and a mass Im of a test droplet ejected from ejecting head 130. The waveform data WD contains a plurality of drive waveforms corresponding to different values of a viscosity η of a droplet in the waveform selection table TBL.

FIG. 4 is a diagram showing an example of the waveform selection table TBL stored in storage unit 180. The waveform selection table TBL shown in the diagram is a table used for determining a drive waveform (hereinafter referred to as "an appropriate drive waveform") such that a mass Im of a droplet ejected from an ejecting head 130 becomes a desired value "10 ng (nanogram)" according to a viscosity η and a mass Im of a droplet ejected under a particular condition. The appropriate drive waveforms defined in the table are those empirically determined in advance so that a droplet of a desired mass "10 ng" can be ejected.

The droplet ejected under the particular condition on which the waveform selection table TBL is based is a droplet ejected by supplying, to ejecting head 130, a drive waveform (hereinafter referred to as "a standard drive waveform") whose voltage drop amount ΔV is "25.0 v" and voltage drop period ΔT is "tc". The standard drive waveform is a waveform capable of causing ejection of a "10 ng" droplet from ejecting head 130 under an ideal ejecting environment where a viscosity of each ink is 7.0 mPa·s (milli Pascal second), and no external shape error or the like is caused at ejecting head 130R, 130G, or 130B.

However, as described above, in actuality, an ink's viscosity change is dependent upon temperature, and ejecting head 130 usually has various types of errors such as a response characteristic error of piezoelectric element 132, an external shape error of a nozzle, and a capacity error of a pressure chamber. Therefore, ejecting a droplet by supplying to ejecting head 130 a drive signal according to the standard drive waveform does not necessarily result in formation of a droplet of "10 ng".

In the waveform selection table TBL, 6 different values of a viscosity of a droplet, "6.0 mPa·s", "6.5 mPa·s", . . . and "8.5 mPa·s" are associated respectively with waveform types "A", "B", . . . and "F" contained in the waveform data WD, so as to make one-to-one correspondence in the listed order.

Figure 5:
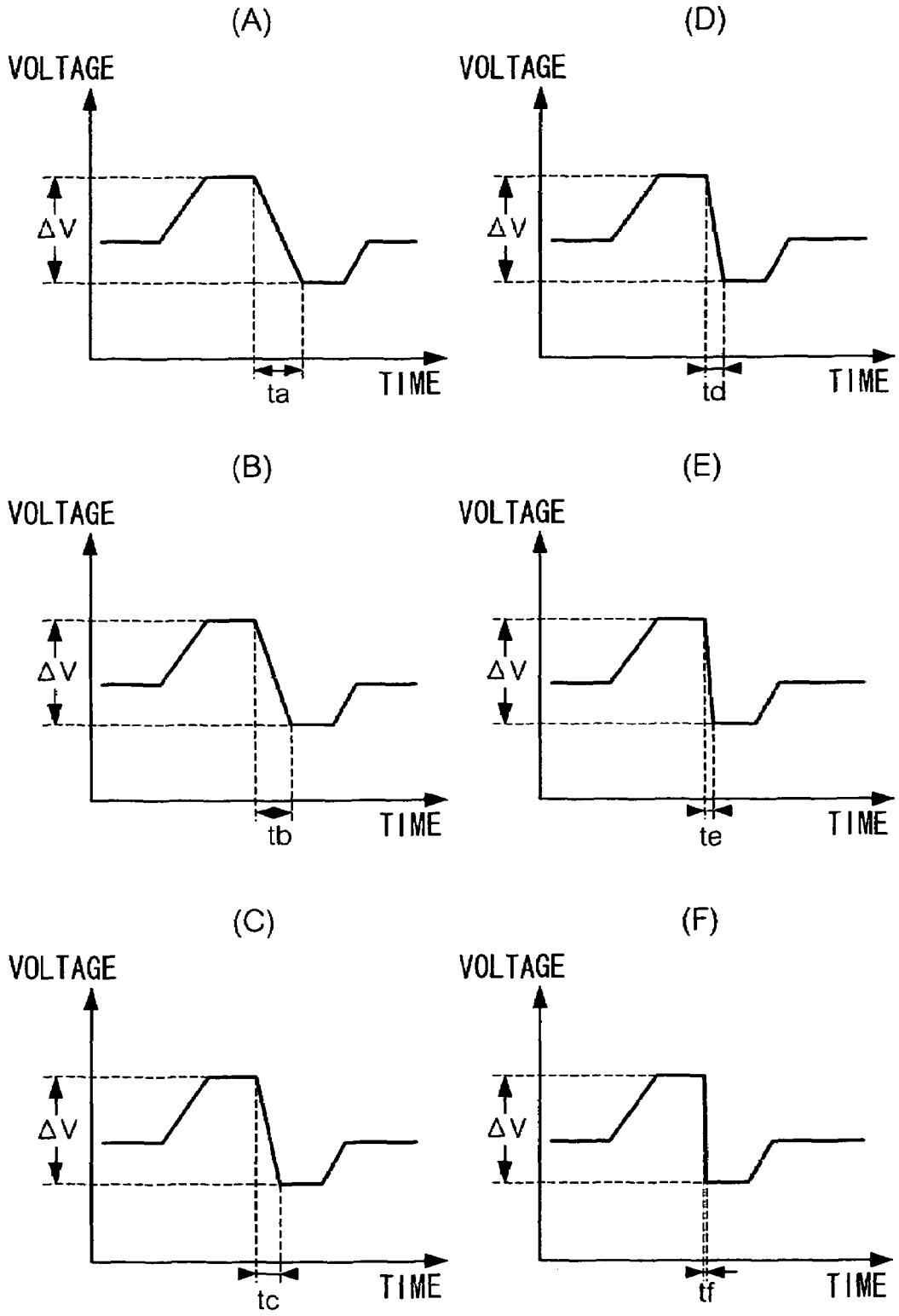
FIG. 5 is a diagram showing an example of waveform data stored in the storage unit.

FIG. 5 is a diagram showing waveform types "A", "B", . . . and "F" contained in the waveform data WD. As shown in the figure, waveform types "A", "B", . . . and "F" are drive waveforms where a voltage drop period ΔT is shorter in the listed order. In other words, we can derive "ta>tb>tc>td>te>tf", where, a "ta" is a voltage drop period of the waveform type "A"; a "tb" is a voltage drop period of the waveform type "B"; a "tc" is a voltage drop period of the waveform type "C"; a "td" is a voltage drop period of the waveform type "D"; a "te" is a voltage drop period of the waveform type "E"; and a "tf" is a voltage drop period of the waveform type "F". Therefore, in the waveform selection table TBL, waveforms are set such that the larger the viscosity η of a droplet, the stronger the ink is pushed out from a nozzle within a voltage drop period ΔT.

In the waveform selection table TBL, 9 different values of mass Im and 6 different values of viscosity η form a total of 54 different combinations of a mass Im and a viscosity η, with each combination being associated with one voltage drop amount ΔV. The voltage drop amount ΔV is smaller when a mass Im of a droplet is larger where a viscosity η of a droplet is equal. That is, where a viscosity η of a droplet is the same, voltage drop amount ΔV is set such that an amount of ink ejected from a nozzle within a voltage drop period ΔT is smaller when a mass Im of a droplet becomes larger.

Figure 6:
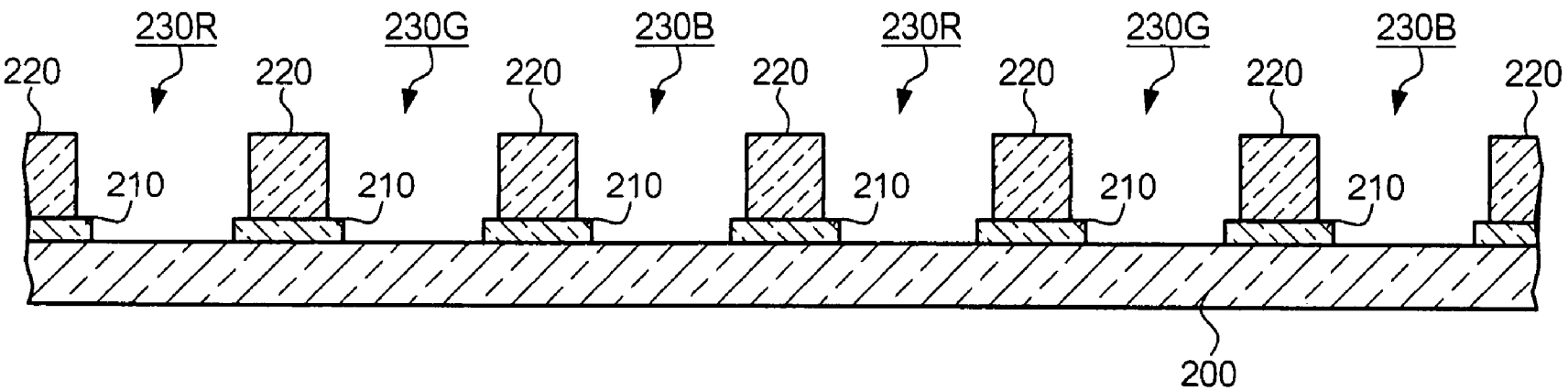
FIG. 6 is a diagram showing an example of a substrate of a color filter to which a droplet is applied.

Next, description will be given of a substrate for a color filter and a structure of components mounted on the substrate with reference to FIG. 6, where ink is applied on the substrate by droplet ejecting device 100. As shown in the figure, substrate 200 that is light transparent, such as glass, is laminated with a shading film 210 and a bank 220 in order from substrate 200's side. Shading film 210 is a thin film made of shading materials such as chromium. Bank 220 is, for example, an acrylic resin and serves as a partition between a coating area 230R where red ink is applied, a coating area 230G where green ink is applied, and a coating area 230B where blue ink is applied in droplet ejecting device 100.

Figure 7:
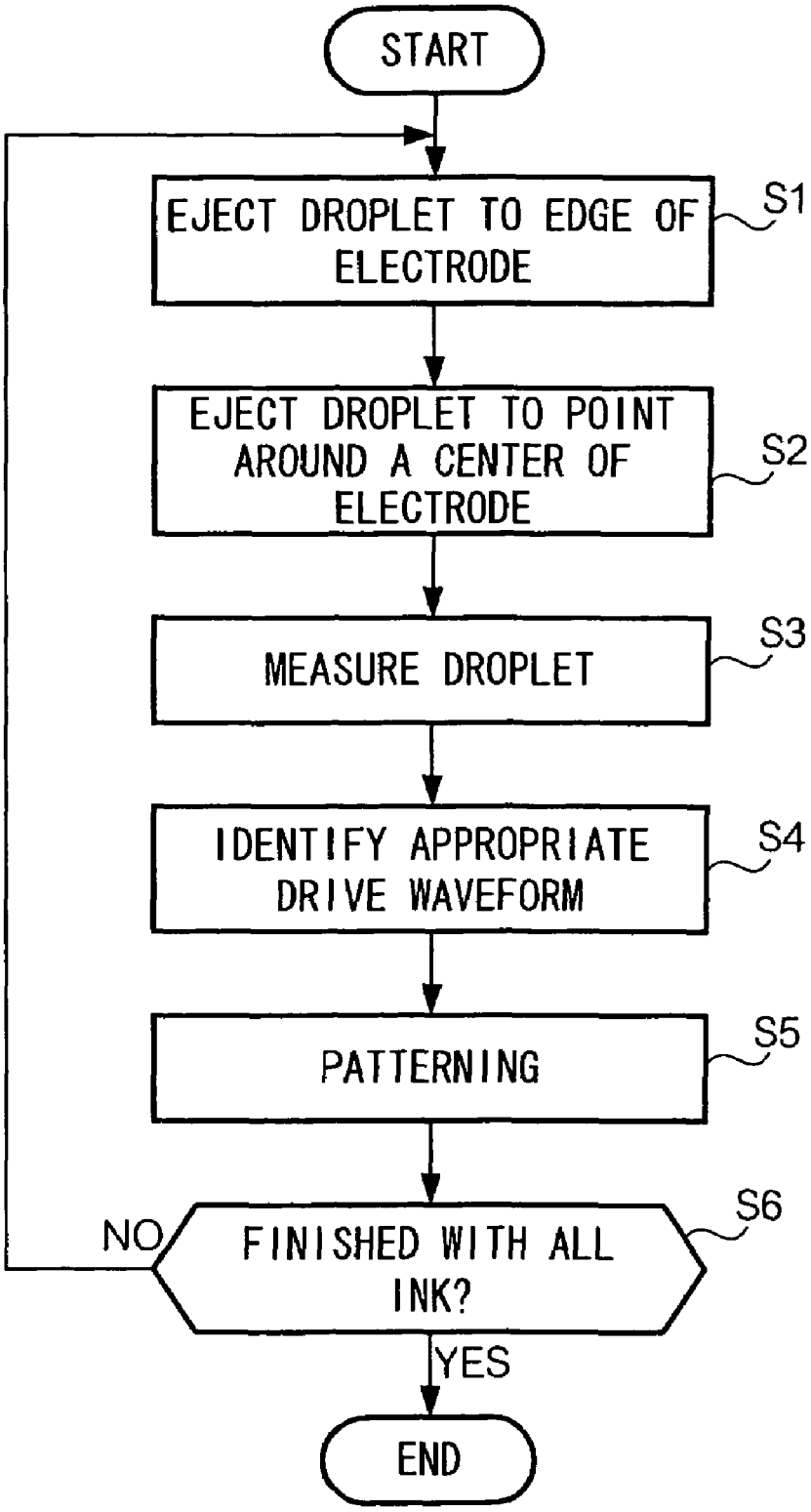
FIG. 7 is a flowchart showing an operation performed at the droplet ejecting device.

Next, description will be given of an operation of patterning a color filter by droplet ejecting device 100 with reference to FIG. 7. The operation is a process of, for each ink stored in tank 120R, 120G, and 120B, ejecting a test droplet responsive to the standard drive waveform, identifying an appropriate drive waveform capable of causing ejection of a droplet of "10 ng" on the basis of a mass Im and a viscosity η of the test droplet, and performing patterning of a color filter using the identified appropriate drive waveform. In droplet ejecting device 100 red ink is first applied onto coating area 230R of substrate 200, green ink then is applied onto coating area 230G, and then blue ink is applied onto coating area 230B.

It is assumed that red ink, green ink, and blue ink stored in each tank 120R, 120G, and 120B have lower temperature in the listed order, and that viscosity of red ink is "6.0 mPa·s"; viscosity of green ink is "7.0 mPa·s"; and viscosity of blue ink is "8.0 mPa·s".

First, control unit 110 causes head carriage 140 to carry ejecting head 130R so that a droplet ejected from ejecting head 130R adheres to an edge of electrode 153*a* of crystal oscillator 154. The edge of electrode 153*a* is, for example, a point PE shown in FIG. 3. Subsequently, control unit 110 causes ejecting head 130R to eject a droplet toward the edge PE of electrode 153*a* by supplying a drive signal to piezoelectric element 132 of ejecting head 130R according to the standard drive waveform whose voltage drop period ΔT is "tc" and whose voltage drop amount ΔV is "25.0 v" (Step S1).

Subsequently, control unit 110 causes head carriage 140 to carry ejecting head 130R so that a droplet ejected from ejecting head 130R adheres to point around a center of electrode 153*a*. The point around the center of electrode 153*a* is, for example, a point PC shown in FIG. 3. Control unit 110 then supplies a drive signal to ejecting head 130R according to the standard drive waveform to cause ejecting head 130R to eject a droplet onto the point around the center PC of electrode 153*a* (Step S2).

Measurement unit 150, when as a result of Step S2 the ejected droplet adheres to the point around the center PC of electrode 153*a*, uses the above described Equations (1), (2), and (3) to obtain a viscosity η and a mass Im of the droplet on the basis of a resonance resistance value R and a changed value Δfreq of resonance frequencies of crystal oscillator 154 between before and after a droplet adheres to the electrode, and supplies droplet information ID indicating the viscosity η and the mass Im to control unit 110 (Step S3).

Control unit 110, upon receiving from measurement unit 150 the droplet information ID, identifies an appropriate drive waveform on the basis of the viscosity η and the mass Im indicated by the droplet information ID.

Before describing an operation relating to the identification of an appropriate drive waveform, description will be given of reasons as to why the appropriate drive waveform is identified on the basis of the viscosity η and the mass Im of the second droplet formed in Step S2 after causing ejection of two droplets in Steps S1 and S2 to cause the droplets adhere to electrode 153*a*.

One such reason is that the first droplet ejected has an unstable characteristic which may be influenced, for example, by dryness caused at a vicinity of a nozzle of ejecting head 130. Another reason is that a response characteristic of crystal oscillator 154 tends not to be stable when the first droplet adheres to the electrode. The first droplet is caused to adhere to the edge PE of electrode 153*a* because a mass Im and a viscosity η of a droplet cannot be detected with high precision when a resonance resistance value R sharply changes; therefore, resonance resistance value R is required to be changed in stages.

Description will be next given of an operation for identifying a drive waveform by control unit 110.

In this example, a viscosity η "6.0 mPa·s" and a mass Im "10.3 ng" of the droplet is obtained by measurement unit 150. A desired value of a mass of a droplet is "10 ng" when red ink is patterned onto substrate 200 according to the standard drive waveform, whereas the mass of the droplet ejected in actuality is "10.3 ng", which is a 3% increase in the applied amount of red ink. As a result, a film thickness of a red filter is 3% greater than a designated value, which prevents provision of a high-quality color display.

Control unit 110, upon receiving the droplet information ID from measurement unit 150, refers to the waveform selection table TBL (see FIG. 4) to identify, on the basis of the viscosity η and the mass Im of the droplet shown in the received droplet information ID, an appropriate drive waveform for causing ejecting head 130 to eject a droplet of "10 ng". Control unit 110 first refers to the waveform selection table TBL and obtains from among the 6 waveform types "A", "B", . . . "F", the waveform type "A" on the basis of the viscosity η "6.0 mPa·s". Next, control unit 110 refers to the waveform selection table TBL to identify the voltage drop amount ΔV. Specifically, control unit 110 identifies, on the basis of the mass Im "10.3 ng" and the viscosity η "6.0 mPa·s" of the droplet, "24.4 v" as the voltage drop amount ΔV. Control unit 110 then identifies a drive waveform satisfying the waveform type "A" and the voltage drop amount ΔV "24.4 v" as an appropriate drive waveform (Step S4).

Figure 8A:
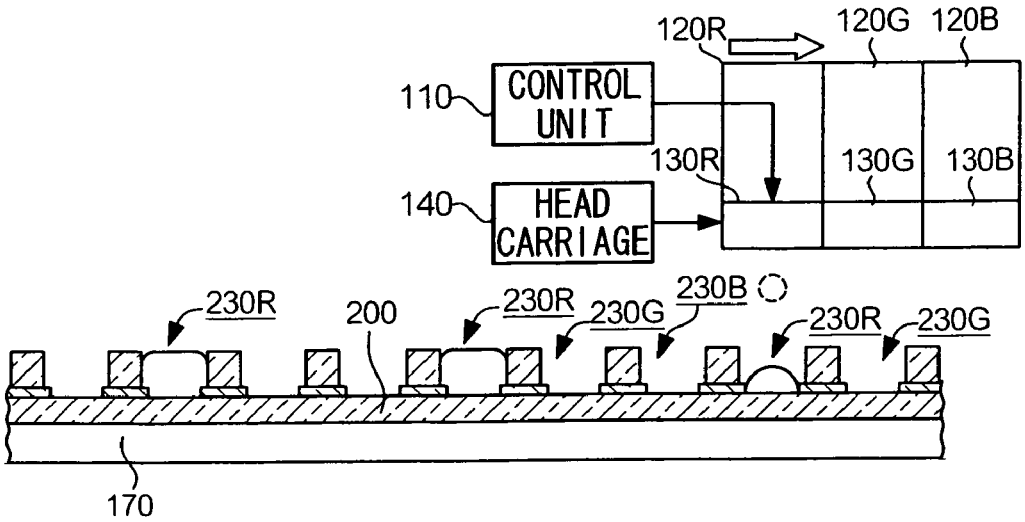
FIGS. 8A to 8C are diagrams showing how a droplet is applied to a substrate.

Subsequently, control unit 110 causes head carriage 140 to scan ejecting head 130R toward substrate 200 as shown in FIG. 8A, and supplies to piezoelectric element 132 of ejecting head 130R a drive signal according to the appropriate drive waveform identified in Step S4. Ejecting head 130R is then caused to eject a droplet of "10 ng" onto coating area 230R, thus a patterning of a red filter is performed (Step S5).

The appropriate drive waveform identified using the waveform selection table TBL is used to eject red ink instead of the standard drive waveform for causing ejection of a droplet of "10.3 ng". As described above, the waveform selection table TBL stores waveform types (voltage drop period ΔT) and voltage drop amount ΔV in correspondence with different values of a viscosity η and a mass Im empirically obtained in advance so as to enable ejection of a droplet of "10 ng". Thus, a droplet ejected from ejecting head 130R responsive to an appropriate drive waveform has a value of just "10 ng" or that sufficiently close to "10 ng" in mass. As a result, red ink having a mass of an approximately desired value is applied in each coating area 230R of the substrate. Red ink applied onto coating areas 230R thus forms a red color filter having the approximately same thickness as a designed value when it becomes dry.

When the patterning of red ink is thus completed, control unit 110 then detects whether the patterning has been completed for every color of ink (Step S6). In this case, the patterning of green ink and blue ink is not completed. Therefore, control unit 110 returns the routine to Step S1 to execute the patterning of next color ink, green ink.

First, control unit 110 causes head carriage 140 to carry ejecting head 130G such that a droplet ejected from ejecting head 130G adheres to the edge of electrode 153*a*. Control unit 110 then supplies a drive signal according to the standard drive waveform to ejecting head 130G, and causes ejecting head 130G to eject a droplet onto the edge PE of electrode 153*a* (Step S1).

Subsequently, control unit 110 causes head carriage 140 to carry ejecting head 130G to a position where a droplet ejected from ejecting head 130G adheres to point around a center of electrode 153*a*. Control unit 110 then supplies a drive signal according to the standard drive waveform to ejecting head 130G to cause ejecting head 130G to eject a droplet onto the point around the center PC of electrode 153*a* (Step S2).

Measurement unit 150, when a droplet ejected in Step S2 adheres to the point around the center of electrode 153*a*, obtains a viscosity η and a mass Im of the droplet on the basis of a resonance resistance value R and a changed value Δfreq of resonance frequencies, and supplies to control unit 110 droplet information ID showing the obtained viscosity η and mass Im (Step S3).

Control unit 110, upon receiving the droplet information ID from measurement unit 150, identifies an appropriate drive waveform using the viscosity η and mass Im shown in the received droplet information ID. In this example, the droplet information ID shows that the mass Im is "10.0 ng" and that the viscosity η is 7.0 mPa·s.

Control unit 110 then refers to the waveform selection table TBL to obtain the waveform type "C" on the basis of the viscosity η "7.0 mPa·s". Control unit 110 again refers to the waveform selection table TBL to obtain the voltage drop amount ΔV "25.0 v" on the basis of the mass Im "10.0 ng" and the viscosity η "7.0 mPa·s". Control unit 110 identifies a drive waveform satisfying the waveform type "C" and the voltage drop amount ΔV "25.0 v", that is the standard drive waveform, as the appropriate drive waveform (Step S4).

Figure 8B:
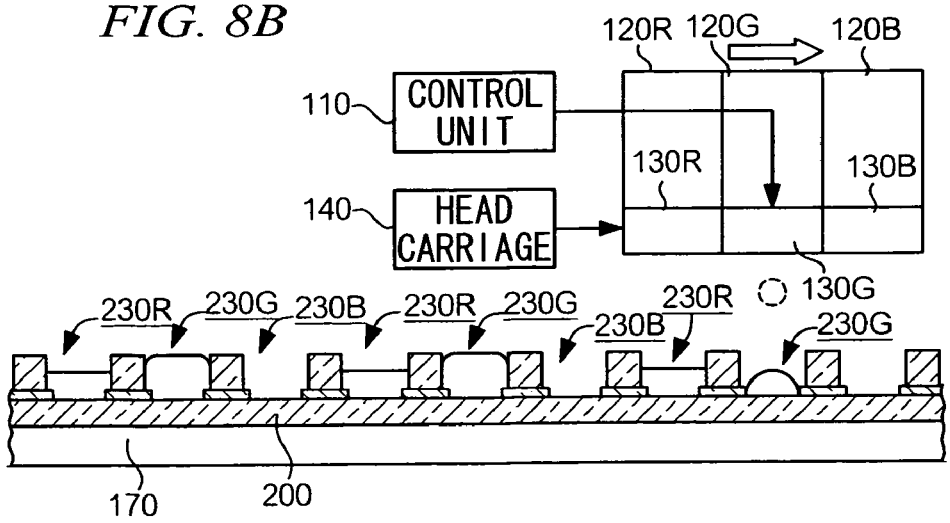

Subsequently, control unit 110 causes head carriage 140 to scan ejecting head 130G toward substrate 200 as shown in FIG. 8B, and supplies a drive signal according to the appropriate drive signal identified in Step S4 to ejecting head 130G, and causes ejecting head 130G to eject a droplet onto coating areas 230G of substrate 200 (Step S5). As a result, a droplet of approximately "10 ng" is ejected from ejecting head 130G, and the droplet is applied to coating areas 230G, thus the patterning of a green color filter is performed.

When the patterning of green ink is thus completed, control unit 110 detects whether the patterning of all the ink is completed (Step S6). At this point, the patterning of blue ink is not yet performed. Therefore, control unit 110 returns the routine to Step S1 to perform the patterning of blue ink.

Control unit 110 causes head carriage 140 to carry ejecting head 130B to a position where a droplet ejected from ejecting head 130B adheres to the edge PE of electrode 153*a*. Control unit 110 then supplies the standard drive waveform to ejecting head 130B to cause ejection of a droplet from ejecting head 130B onto the edge PE of electrode 153*a* (Step S1).

Next, control unit 110 causes head carriage 140 to carry ejecting head 130B to a position where a droplet ejected from ejecting head 130B adheres to the point around the center PC of electrode 153*a*. Control unit 110 then supplies a drive signal according to the standard drive waveform to ejecting head 130B to cause ejecting head 130B to eject a droplet towards the point around the center PC of electrode 153*a* (Step S2).

When a droplet ejected in Step S2 adheres to the point around the center PC of electrode 153*a*, measurement unit 150 obtains a viscosity η and a mass Im of the droplet on the basis of a resonance resistance value R and a changed value Δfreq in resonance frequency of the droplet, and supplies the droplet information ID showing the obtained viscosity η and the mass Im to control unit 110 (Step S3).

Control unit 110, upon receiving the droplet information ID from measurement unit 150, identifies an appropriate drive waveform on the basis of the viscosity η and the mass Im shown in the received droplet information ID. In this example, the droplet information ID shows the mass Im as "9.5 ng" and the viscosity η as "8.5 mPa·s".

If the standard drive waveform is used to pattern blue ink onto substrate 200, a mass of a droplet ejected in actuality would be "9.5 ng", whereas a desired mass of a droplet is "10 ng". That is, the applied amount of blue ink is 5% less than the desired mass. As a result, a blue filter contained in the color filter is 5% thinner than the designed value, and therefore a high-quality color display cannot be achieved.

To cope with the problem, droplet ejecting device 100 identifies an appropriate drive waveform as in the following, and supplies a drive signal according to the identified drive waveform to ejecting head 130B as follows. First, control unit 110 refers to the waveform selection table TBL to identify the waveform type "F" on the basis of the viscosity η "8.5 mPa·s" of the droplet. Control unit 110 again refers to the waveform selection table TBL to obtain the voltage drop amount ΔV. Specifically, the voltage drop amount ΔV "28.5 v" is obtained on the basis of the mass Im "9.5 ng" and the viscosity η "8.5 mPa·s" of the droplet. Control unit 110 then identifies as an appropriate drive waveform a drive waveform satisfying the waveform type "F" and the voltage drop amount ΔV "28.5 v" (Step S4).

Figure 8C:
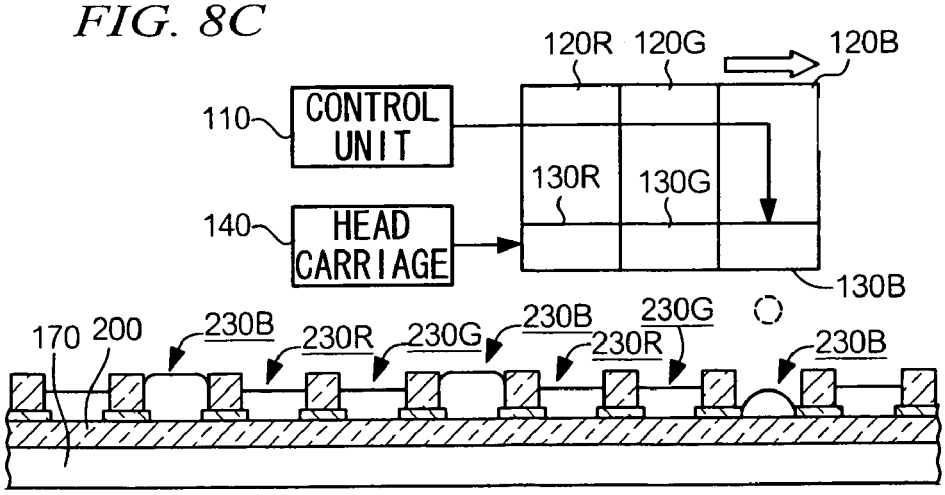

Control unit 110 then causes head carriage 140 to scan ejecting head 130B toward substrate 200 as shown in FIG. 8C, and supplies a drive signal according to the appropriate drive waveform identified in Step S4 to ejecting head 130B. As a result, ejecting head 130B is caused to eject a droplet of "10 ng", and the droplet is applied onto coating area 230B. As a result, a blue filter with a film having approximately the same thickness as a designed value is formed in each coating area 230B of substrate 200.

Thus, droplet ejecting device 100 according to the present embodiment measures a mass Im and a viscosity η of a droplet, identifies an appropriate drive waveform to be supplied to ejecting head 130 on the basis of a result of the measurement, and causes ejecting head 130 to eject a droplet responsive to the appropriate drive waveform. Therefore, droplet ejecting device 100 according to the present embodiment has various advantages over the conventional droplet ejecting device as in the following.

In a conventional technique, a drive waveform is determined on the basis of an estimated viscosity of a droplet on the basis of a temperature detected by a thermal sensor provided close to an ejecting head, such that the determined waveform causes ejection of a droplet of an approximately constant amount. Since an approximate viscosity is obtained on the basis of the temperature in the technique, there is a probability of the estimated viscosity being inaccurate. Furthermore, a detection error is likely to be caused since a detected temperature varies depending on a location where the thermal sensor is installed.

In comparison with the conventional technique, droplet ejecting device 100 according to the present embodiment directly detects a viscosity η of a droplet by means of measurement unit 150. Thus, there is a lower probability of a detection error occurring, and a characteristic of the liquid can be obtained with greater precision.

Furthermore, the present embodiment has the following advantages over the conventional technique in that a drive waveform is determined on the basis of a mass Im of an ejected droplet in addition to its viscosity η. As described above, factors causing an error in an amount of a droplet include an error in a response characteristic of piezoelectric element 132, an error in a nozzle diameter, a difference in rigidity of a portion on which piezoelectric element 132 is mounted, a volume error of a pressure chamber, an electrical cross-talk when a drive waveform is applied to piezoelectric element 132, and others in addition to a change in ink viscosity η. Also, a mass of a droplet is lower when an atmospheric pressure is lower.

Therefore, when a drive waveform is determined only on the basis of the viscosity η as in the conventional art, the influence of other factors is not taken into account; and a mass Im of the liquid is not stabilized with sufficient precision. Conversely, according to the present embodiment, two parameters, a viscosity η and a mass Im of a droplet, are used to determine an appropriate drive waveform. Not only is an influence of the viscosity η reflected, but also an influence of an outer shape error of ejecting head 130R, 130G, and 130G is reflected in the mass Im. Thus, in comparison with the conventional technique of determining an appropriate drive waveform only on the basis of viscosity η, the present invention enables ejection of a droplet with a constant mass with higher stability.

In another conventional method, an electro balance is used to measure an average weight of droplets ejected from an ejecting head, and a drive waveform is determined on the basis of the measured value. In this conventional technique, 20,000 to 50,000 droplets are ejected from each nozzle of an ejecting head. The total weight of the ejected droplets is measured by an electro balance, and the measured total weight is divided by the number of droplets to thereby obtain an average weight of one droplet. An appropriate drive waveform is determined on the basis of the average weight thus obtained. According to this technique, a higher stability of a volume of a droplet can be achieved as compared to a method of ejecting a droplet on the basis of a single, unchanged drive waveform. However, an ejecting head is usually provided with a large number of nozzles, for example, 192 nozzles; therefore, when 20,000 to 50,000 droplets are ejected from each nozzle, a liquid such as an ink is consumed in large quantities.

When compared to this technique, droplet ejecting device 100 according to the present embodiment is capable of measuring a mass Im of a droplet for each droplet on the basis of a changed value Δfreq in resonance frequency and a resonance resistance R. Thus, the liquid is not consumed in large quantities in determining a drive waveform, resulting in conservation of a liquid such as ink. Further, since in the present embodiment the liquid is not used in large quantities, it is also possible to reduce a cost of a product manufactured using droplet ejecting device 100, and to also dramatically shorten a time required for determining an appropriate drive waveform.

Also, the conventional technique using an electro balance only obtains an average weight of one droplet, and it is therefore difficult to determine whether an error is caused in a mass Im among different droplets. In contrast, droplet ejecting device 100 is capable of obtaining a mass Im for each droplet; and an error existing among different droplets can be easily identified.

It should be noted that the present invention is not restricted to the foregoing embodiment, and various modifications and improvements can be made to the above embodiment.

For example, in the above described embodiment, an AT cut crystal oscillator is used to measure a mass Im and a viscosity η of a droplet. Instead, a GT-cut crystal oscillator, a surface acoustic wave (SAW) element, or a piezoelectric ceramics element may be used to measure a mass Im and a viscosity η as in the above described embodiment.

Also, Equations (1), (2), and (3) are shown in the above embodiment as examples of equations showing relational expressions for obtaining a viscosity η and a mass Im of a droplet. However, a rule for obtaining a viscosity η and a mass Im is not limited to that expressed in the above equations, and other relational expressions using different constants and parameters or an approximate expression may be used.

In addition, in the above embodiment, both of "a waveform type" and "a voltage drop amount ΔV" of a drive waveform may be selected on the basis of a viscosity η and a mass Im. Either one of a waveform type or a voltage drop amount ΔV may be selected to achieve a stability of a mass Im of a droplet.

Instead of "a waveform type" and "a voltage drop amount ΔV", a period between times "T1" and "T2" shown in FIG. 2 may be adjusted to achieve stability of droplets being ejected. Specifically, in general the longer the period "T2−(minus) T1" becomes, the larger the amount of ink flowing into respective pressure chambers of ejecting heads 130R, 130G, and 130B from tanks 120R, 120G, and 120B becomes; as a result, a droplet of a larger mass Im can be ejected. Therefore, when a mass Im of a droplet is smaller than a desired mass Im, the period "T2−T1" should be made longer; when a mass Im of a droplet is larger than a desired mass Im, the period "T2−T1" should be made shorter.

Further, in the above embodiment, an example is shown of using a waveform selection table TBL in determining an appropriate drive waveform, but a method of determining an appropriate drive waveform is not limited to the example. For example, a function may be used if it has as its parameters a viscosity η and a mass Im and is capable of uniquely identifying "a voltage drop amount ΔV". The "voltage drop amount ΔV" is identified using such a function, and an appropriate waveform may be determined on the basis of the identified voltage drop amount ΔV.

Applications of droplet ejecting device 100 are not limited to a patterning of a color filter for an electronic optical device but can be used for formation of a thin film layer such as in the following. For example, droplet ejecting device 100 may be used for formation of a thin film such as an organic EL(electroluminescence) layer or a hole injection layer included in an organic EL display panel. Specifically, when an organic EL layer is formed, a droplet containing organic EL materials such as polythiophene base conductive high molecular substance is ejected onto coating areas partitioned by banks formed on a substrate, thereby applying a droplet onto the coating areas. When the applied liquid becomes dry, an organic EL layer is formed in each coating area.

Other applications of droplet ejecting device 100 include formation of a device such as a secondary wiring of a transparent electrode included in a plasma display, an antenna included in an IC (integrated circuit) card. Specifically, liquid comprising an organic liquid such as tetradecane mixed with conductive particles such as silver particles is patterned by droplet ejecting device 100, and a metal thin film layer is formed when the organic liquid becomes dry.

Additionally, droplet ejecting device 100 is capable of applying a droplet containing various materials such as a heat hardening resin and an UV hardening resin used for three-dimensional modeling micro lens array materials, and biosubstance such as DNA (deoxyribonucleic acid) and proteins.

According to droplet ejecting device 100 of the present embodiment, a mass Im of a droplet ejected is caused to be stable, and therefore high-precision patterning of the above materials is possible. Also, since a mass Im and a viscosity η of each droplet can be measured, materials are not consumed in large quantities in determining an appropriate drive waveform.

Electronic Optical Device and Electronic Device:

Description will now be given of an electronic optical device having a color filter formed using the above described droplet ejecting device 100, and of an electronic device employing the electronic optical device as its display unit.

Figure 9:
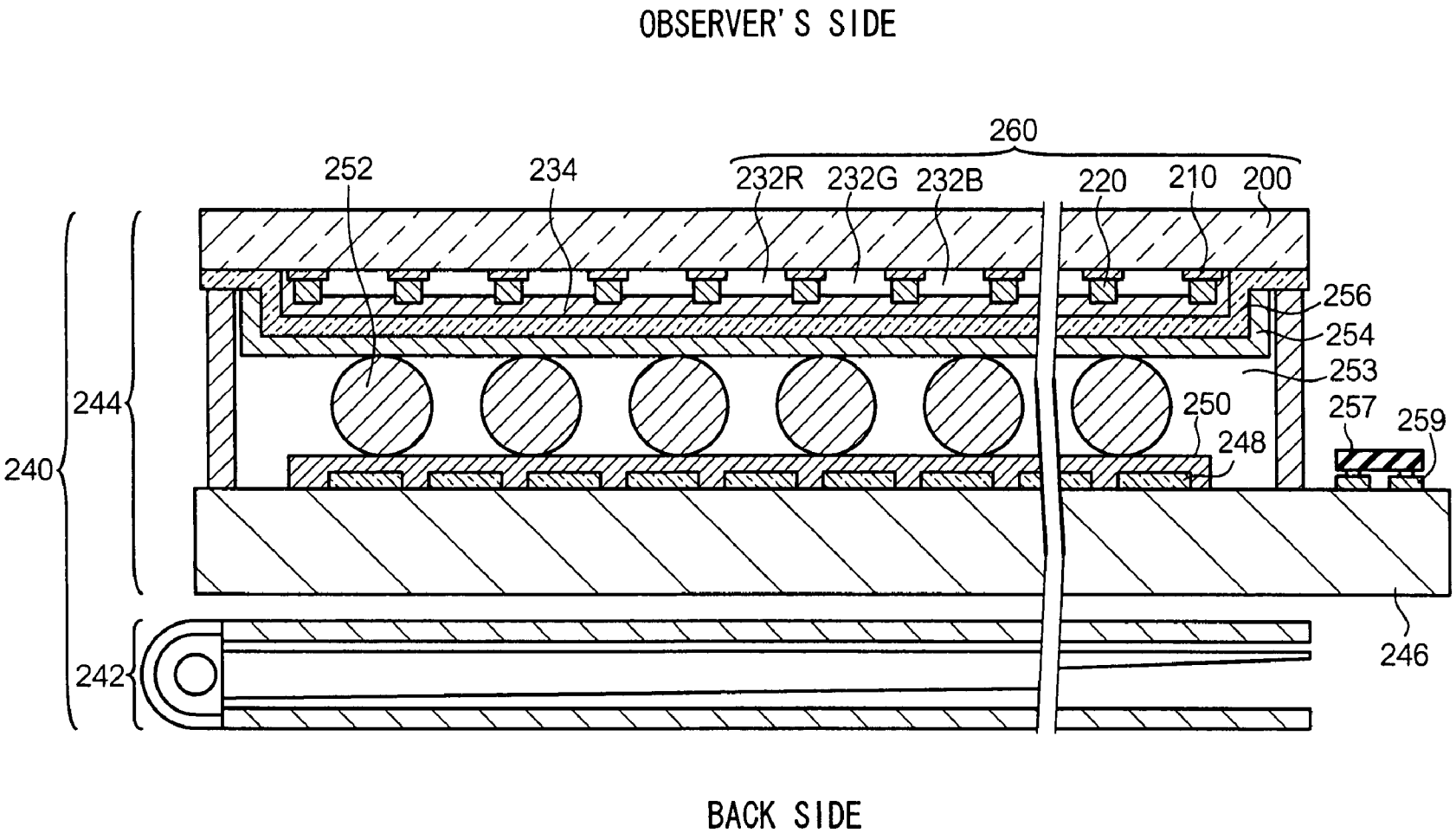
FIG. 9 is a diagram showing an example of an electronic optical device.

FIG. 9 is a sectional view of an electronic optical device having a color filter. As shown in the figure, electronic optical device 240 comprises, to describe roughly, a back light system 242 for emitting light to an observer's side, and a passive-type liquid crystal display panel 244 for selectively transmitting light emitted from back light system 242. Liquid crystal display panel 244 comprises a substrate 246, an electrode 248, an orientation film 250, a spacer 252, an orientation film 254, an electrode 256, and a color filter 260. Color filter 260 is shown upside down compared with the previously shown figure, and substrate 200 is located on the upper side (observer's side) in relation to bank 220. Red color filter 232R, green color filter 232G, and blue color filter 232B included in color filter 260 are patterned by droplet ejecting device 100, and have approximately the same thickness as a designed value. Also, on the back side of each color filter 232R, 232G, and 232B, there is provided an overcoat layer 234 that serves to protect each color filter. A space between two orientation films 250 and 254 facing each other through spacers 252 encloses liquid crystal 253.

Liquid crystal driving IC 257 supplies a drive signal to electrode 248, 256 through wirings and the like 259. When a drive signal is thus supplied to electrode 248, 256, the orientation of a corresponding liquid crystal 253 changes. As a result, liquid crystal display panel 244 selectively transmits light emitted from back light system 242 for each region (sub pixel) corresponding to each color filter 232R, 232G, and 232B.

Figure 10:
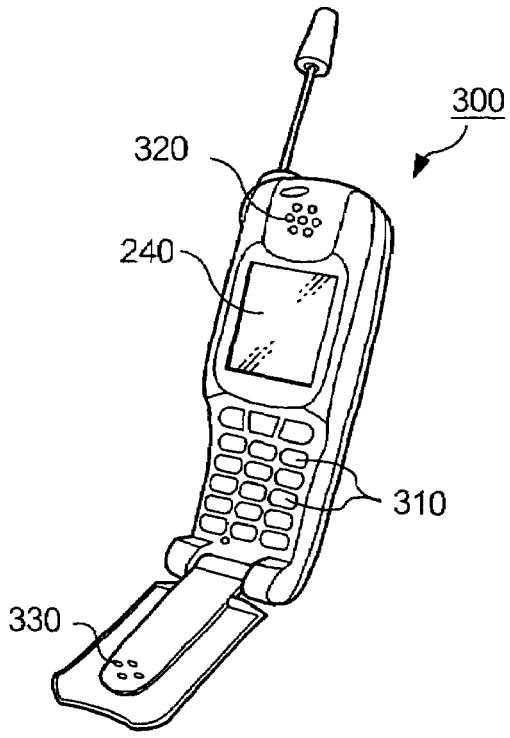
FIG. 10 is a diagram showing an example of an electronic device in which an electronic optical device is provided.

FIG. 10 is an external view of a mobile phone 300 having electronic optical device 240 mounted thereto. In the figure, mobile phone 300 comprises electronic optical device 240 having a color filter as a display unit for displaying a variety of information such as telephone numbers, in addition to a plurality of operation buttons 310, a receiver 320, and a mouthpiece 330.

In addition to mobile phone 300, electronic optical device 240 manufactured by means of droplet ejecting device 100 may be used as a display unit for various electronic devices such as a computer, a projector, a digital camera, a movie camera, PDA (Personal Digital Assistant), vehicle-mounted equipment, a photocopier, or audio equipment.

The entire disclosure of Japanese Patent Application No. 2003-003726 filed Jan. 9, 2003 is hereby incorporated by reference.

What is claimed is:

1. A waveform determining device comprising:

a measuring unit that measures a viscosity and a mass of a droplet ejected from an ejecting head for ejecting a droplet in accordance with a drive waveform;

a table memory that stores a table, the table including a plurality of voltage drop amounts and a plurality of waveform types, each waveform type identifying a duration of a voltage drop and corresponding to a viscosity, each voltage drop amount corresponding to a mass of a droplet; and a waveform determining unit that determines a drive waveform to be supplied to the ejecting head, the drive waveform having a voltage drop, the voltage drop amount being determined on the basis of the table in response to the mass of the droplet measured by the measuring unit, the duration of the voltage drop being determined on the basis of the table in response to the viscosity of the droplet measured by the measuring unit, the drive waveform causing ejection of a droplet of an approximately constant volume from the ejecting head.

2. A waveform determining device according to claim 1, wherein the measuring unit comprises:

a piezoelectric element having an electrode to which a voltage is applied to cause the piezoelectric element to vibrate, such that when the droplet ejected from the ejecting head adheres to the electrode during application of a voltage, the piezoelectric element vibrates at a resonance frequency that is dependent on a viscosity and a mass of the adhering droplet, and the piezoelectric element also indicates a resonance resistance that is dependent on a viscosity of the adhering droplet;

a resonance resistance value obtaining unit that obtains a resonance resistance value of the piezoelectric element when the droplet ejected from the ejecting head adheres to the electrode;

a frequency change obtaining unit that obtains a difference in resonance frequency of the piezoelectric element at a time of adhesion of the droplet to the electrode and at a time of no adhesion of the droplet to the electrode; and a computing unit that computes the viscosity and the mass of the droplet adhering to the electrode on the basis of the resonance resistance value obtained by the resonance resistance value obtaining unit and the difference in resonance frequency of the piezoelectric element obtained by the frequency change obtaining unit.

3. A waveform determining device according to claim 2, wherein the computing unit is operable to compute the viscosity of the droplet adhering to the electrode on the basis of the resonance resistance value obtained by the resonance resistance value obtaining unit and the difference in resonance frequency of the piezoelectric element obtained by the frequency change obtaining unit; and is operable to compute the mass of the droplet adhering to the electrode on the basis of difference in resonance frequency obtained by the frequency change obtaining unit.

4. A waveform determining device according to claim 1, wherein the droplet measured by the measuring unit is ejected when a predetermined standard drive waveform is supplied to the ejecting head; and wherein the waveform determining unit comprises:

a waveform memory that stores a plurality of drive waveforms, each drive waveform corresponding to a viscosity and a mass of the droplet ejected from the ejecting head in accordance with the standard drive waveform; and a waveform selector that selects, from among the plurality of drive waveforms stored in the waveform memory, a drive waveform corresponding to both the viscosity and the mass of the droplet measured by the measuring unit to supply the selected drive waveform to the ejecting head.

5. A droplet ejecting device comprising:

an ejecting head for ejecting a droplet according to a drive waveform; and a waveform determining device according to claim 1, wherein the drive waveform determined by the waveform determining device is supplied to the ejecting head.

6. A waveform determining method for a waveform determining device including a table memory that stores a table, the table including a plurality of voltage drop amounts and a plurality of waveform types, each waveform type identifying a duration of a voltage drop and corresponding to a viscosity, each voltage drop amount corresponding to a mass of a droplet, the method comprising:

measuring a viscosity and a mass of a droplet ejected from an ejecting head for ejecting a droplet in accordance with a drive waveform; and determining a drive waveform to be supplied to the ejecting head, the drive waveform having a voltage drop, the voltage drop amount being determined on the basis of the table in response to the mass of the droplet measured by the measuring unit, the duration of the voltage drop being determined on the basis of the table in response to the viscosity of the droplet measured by the measuring unit, the drive waveform causing ejection of a droplet of an approximately constant volume from the ejecting head.

7. A waveform determining method according to claim 6, wherein the measuring step comprises:

ejecting a droplet from the ejecting head toward an electrode of a piezoelectric element, the piezoelectric element being caused to vibrate when a voltage is applied to the electrode, such that when a droplet ejected from the ejecting head adheres to the electrode during application of a voltage, the piezoelectric element vibrates at a resonance frequency that is dependent on a viscosity and a mass of the adhering droplet, and the piezoelectric element also indicates a resonance resistance that is dependent on a viscosity of the adhering droplet;

obtaining a resonance resistance value of the piezoelectric element when the droplet ejected from the ejecting head adheres to the electrode;

obtaining a difference in resonance frequency of the piezoelectric element at a time of adhesion of the droplet to the electrode and at a time of no adhesion of the droplet to the electrode; and computing the viscosity and the mass of the droplet adhering to the electrode on the basis of the resonance resistance value obtained in the resonance resistance value obtaining step and the difference in resonance frequency of the piezoelectric element obtained in the frequency difference obtaining step.

8. A waveform determining method according to claim 7, wherein the computing step includes computing the viscosity of the droplet adhering to the electrode on the basis of the resonance resistance value obtained in the resonance resistance value obtaining step and the difference in resonance frequency of the piezoelectric element obtained in the frequency change obtaining step; and computing the mass of the droplet adhering to the electrode on the basis of the difference in resonance frequency obtained in the frequency change obtaining step.

9. A waveform determining method according to claim 6, wherein the droplet is ejected when a predetermined standard drive waveform is supplied to the ejecting head; and wherein the waveform determining step includes selecting a drive waveform that corresponds to the viscosity and the mass of the droplet measured in the measuring step as the drive waveform to be supplied to the ejecting head, from among a plurality of drive waveforms stored in a waveform memory, with each drive waveform corresponding to a viscosity and a mass of the droplet ejected from the ejecting head in accordance with the standard drive waveform and causing ejection of a droplet of an approximately constant volume from the ejecting head.

10. A waveform determining method according to claim 7, further comprising:

ejecting from the ejecting head a droplet approximately towards an edge of the electrode, the ejecting step taking place before the droplet ejection step, wherein the droplet ejection step includes ejecting a droplet from the ejecting head approximately towards a center of the electrode.

11. A droplet ejecting method comprising:

supplying to the ejecting head the drive waveform determined by the waveform determining method according to claim 6, thereby causing ejection of a droplet from the ejecting head.

12. A film forming method comprising a manufacturing process of applying a droplet by the droplet ejecting method according to claim 11.

13. A device manufacturing method comprising a manufacturing process of forming a film by the film forming method according to claim 12.

14. A manufacturing method for manufacturing an electronic optical device, comprising a manufacturing process of manufacturing a device by the device manufacturing method according to claim 13.

15. An electronic optical device which is manufactured by the manufacturing method for manufacturing an electronic optical device according to claim 14.

16. An electronic device comprising, as a display unit, the electronic optical device according to claim 15.

* * * * *